US005246823A

United States Patent [19]

Shuman

[11] Patent Number: 5,246,823

[45] Date of Patent: Sep. 21, 1993

[54] PHOTOGRAPHIC ELEMENT HAVING IMPROVED ANTIHALATION LAYER CONTAINING TABULAR SILVER GRAINS

[75] Inventor: David C. Shuman, Victor, N.Y.

[73] Assignee: Eastman Kodak Company, Rochester, N.Y.

[21] Appl. No.: 699,755

[22] Filed: May 14, 1991

[51] Int. Cl.[5] ..... G03C 1/815

[52] U.S. Cl. ..... 430/510; 430/523; 430/530; 430/559

[58] Field of Search ..... 430/510, 523, 539, 530

[56] References Cited

U.S. PATENT DOCUMENTS

| | | | |
|---|---|---|---|
| 2,921,914 | 1/1966 | Pechmann . | |
| 3,333,960 | 8/1967 | Posse et al. . | |
| 3,650,753 | 3/1972 | Bacon | 430/510 |
| 3,674,703 | 7/1972 | Noll et al. | 430/510 |
| 4,460,679 | 7/1984 | Schadt, III . | |
| 4,563,406 | 1/1986 | Ohbayashi et al. . | |
| 4,990,437 | 2/1991 | Komatsu et al. | 530/510 |
| 5,009,993 | 4/1991 | Inoue et al. | 430/510 |
| 5,051,342 | 9/1991 | Shisa et al. | 430/510 |

FOREIGN PATENT DOCUMENTS 1126797 9/1968 United Kingdom .

OTHER PUBLICATIONS

Defensive Publication-U.S.-No. T900,010, published Jul. 18, 1972, Shuman, David C.

James, The Theory of the Photographic Process, 4th Ed., p. 579.

*Primary Examiner*—Jack P. Brammer

*Attorney, Agent, or Firm*—Foley & Lardner

[57] ABSTRACT

A photographic element according to the invention includes a reflective support, one or more photosensitive silver halide emulsion layers, and a colored antihalation layer interposed between the support and the photosensitive layers. The antihalation layer comprises thin grains of silver in the form of platelets having a thickness of up to about 20 nm. The platelets are distributed in a suitable matrix or colloidal medium such as gelatin. The thinness of the platelets allows the antihalation layer to be formed effectively at lower silver levels.

19 Claims, No Drawings

PHOTOGRAPHIC ELEMENT HAVING IMPROVED ANTIHALATION LAYER CONTAINING TABULAR SILVER GRAINS

FIELD OF THE INVENTION

This invention relates to antihalation materials used in photographic elements, particularly to an antihalation layer for use in a color silver halide film.

BACKGROUND OF THE INVENTION

Halation has been a persistent problem with photographic films formed by depositing one or more layers of a photosensitive silver halide emulsion onto a support such as a plastic film. The emulsion diffusely transmits light. Such light reaches the support and is reflected back into the emulsion. The silver halide emulsion is thereby reexposed at a location different from the original one. The result is a halo surrounding an image of a bright object on the film.

Three methods have been proposed for preventing such halation. One such method calls for dyeing the support, another for providing a dyed or pigmented layer behind the clear support as an antihalation backing. A third method involves providing a silver antihalation layer between the support and the photosensitive layer(s). Gray silver has been used for this purpose; see James, *The Theory of the Photographic Process*, 4th Ed., p. 579. The process of making a grey antihalation layer involves precipitation of silver chloride and the addition of a fogging developer to produce filamentary silver similar to the morphology customarily encountered when conventional silver halide films are processed in a B/W developer.

Halation reduces the sharpness of the resulting image. Efforts to minimize the effects of halation have included incorporation of silver or silver halide in the support to lower reflection density. See U.K. Patent No. 1,126,797. Schadt U.S. Pat. No. 4,460,679, issued Jul. 17, 1984, approaches the problem by adding a nonphotosensitive layer containing a chemically bleachable, high strength tinctorial colorant, such as blue colloidal silver, over the support which permits sensitometric control over low coating weight silver halide elements. Ohbayashi U.S. Pat. No. 4,563,406, issued Jan. 7, 1986, places a yellow, blue or gray colorant layer, a white pigment layer and a silver halide emulsion layer over the support to achieve the combined effect of increased sharpness without loss of sensitivity.

Pechmann U.S. Pat. No. 2,921,914, issued Jan. 19, 1966, uses a blue colloidal silver dispersion to absorb longer wavelengths of light for halation control. Preparation of this dispersion involves spontaneous nucleation to derive centers for silver formation, and reduction of the silver salt by tannic acid in the presence of a water soluble strontium salt. This technique has hue control problems related to large nuclei, turbidity and difficulties with bleaching. Severe gel slugging (forming hardened globs), a major concern in antihalation silver preparation, is aggravated by the use of tannic acid. Posse U.S. Pat. No. 3,333,960 issued Aug. 1, 1967, discloses mixing of the Pechmann blue silver with yellow Carey-Lea silver to obtain a neutral coloration which controls halation. Neither approach is completely effective, particularly at low coverage levels. Blue colloidal silver materials made by development of fine silver nuclei have been proposed for use in halide-ion sensitive imaging systems and thermal imaging systems. See Defensive Publication T 900,010 and copending U.S. patent application Ser. No. 07/344,950, filed Apr. 28, 1989, the entire content of which is incorporated by reference herein. The present invention advantageously applies such materials to form antihalation layers displaying improved performance.

SUMMARY OF THE INVENTION

A photographic element according to the invention includes a reflective support, one or more photosensitive silver halide emulsion layers, and a colored antihalation layer interposed between the support and the photosensitive layers. The antihalation layer comprises platelets of silver having a thickness of up to about 20 nanometers (nm) distributed in a suitable matrix or colloidal medium such as gelatin. According to a preferred aspect of the invention, the grains include generally tabular grains having an average edge length at least twice the thickness thereof. Due to the thinness of the grains, coverage of up to about 10 mg silver per square foot of the antihalation layer provides a sufficient antihalation effect at reduced silver levels as compared to silver antihalation layers containing larger, thicker grains.

The antihalation layer of the invention is generally obtained by forming nuclei of a size less than about 20 nanometers in diameter dispersed in a colloidal matrix, mixing a solution of the nuclei-containing dispersion with a silver ion-containing solution, plating the nuclei in the solution with the silver, terminating the plating process to obtain particles of the desired color, and coating the resulting particles onto a support to form an antihalation layer. The plating step is preferably carried out by reduction of a silver salt with a reducing agent. According to a further aspect of the invention, it has been found that certain reducing agents are effective for this purpose without creating other problems.

To form a photosensitive element according to the invention, one or more photosensitive layers are formed on the antihalation layer. For this purpose the invention provides a step of passivating the silver in the antihalation layer against conversion to its yellow form by halide present in the adjoining photosensitive layer.

DETAILED DESCRIPTION

Unlike other methods for forming antihalation layers described in the art, the present invention deposits silver onto preformed nuclei by a chemical amplification technique that provides conditions leading to two-dimensional (planar) growth of the starting nuclei into platelets of extraordinarily small size. The process is broken down into the two distinct phases, nuclei preparation and amplification. The small silver nuclei may be prepared by the reduction of silver nitrate in gelatin by the use of a strong reducing agent. During amplification of the nuclei the color undergoes a change from yellow to orange to red-orange to red to purple to blue. Any of these colors can be selected by controlling the degree of amplification, i.e., the ratio of starting nuclei to the amount of silver in the amplifying bath. As that ratio favors higher and higher amounts of plated silver, the color shifts from orange to blue. Example 1 below describes preparation of the blue form. Amplification can also be terminated by quenching as described below.

According to a preferred form of the invention, the nuclei are created by adding a silver solution, preferably silver nitrate, to a peptizing medium (such as an aqueous gelatin solution) containing a reducing agent. Although the medium containing the nuclei is preferably gelatin, other hydrophilic or natural polymers or alkali metal fatty acid salts may be used. The reducing agent is preferably potassium borohydride, but other strong reducing agents such as other hydrides, dimethylamine borane, stannous chloride, stannous ion, etc. may also be used.

The silver nitrate solution used to form the nuclei is added with vigorous stirring to the peptizing medium containing the reducing agent. If the peptizing medium is gelatin, the suspended silver nuclei are stirred and then cooled to set the gelatin. The reduction of the silver ions by the borohydride or other comparable reducing agent gives exceedingly small metal nuclei which are used during amplification to form extremely fine metal platelets.

The resulting dispersion is extruded, e.g., through a screen, to form nuclei dispersed in discrete gelatin particles in the shape of noodles. If a 50 mesh stainless steel screen is used, the 5–7 nm diameter nuclei are dispersed in gelatin noodles having an average diameter of about 250–300 micrometers. To prevent the gelatin noodles from agglutinating into large clumps, which would hinder uniform amplification, the dispersion may be further diluted with water to provide nuclei in a solid gelatin matrix distinct from the aqueous phase.

Two alternative methods can be used to produce the dispersion noodles, namely underwater noodling and chillplate noodling. In underwater noodling, the material is first cooled to a temperature just above the setting or gelation point in a chiller or heat exchanger. The cooled product is then pumped through a noodle head suspended in a tank of chilled water (around 5°–8° C.). The noodle head generally consists of a hollowed cylinder of nylon (or other similar inert plastic) with small holes bored around the perimeter, such as 0.6 or 1.6 mm holes. When the dispersion leaving the holes comes in contact with the much colder water, the gel sets immediately, producing a continuous noodle strand out of each hole. Chilled water is continually added to the top of the tank and the noodles are drawn off with the water at the bottom. In chillplate noodling, the dispersion is set in a barrel chiller and forced through a stainless steel plate drilled with holes of the required size. The noodles then drop into chilled water for washing.

Underwater noodling is preferred because it produces a smooth uniform noodle and lends itself towards a continuous process. It does not generate a lot of small flakes or particles of dispersion (fines), and this helps reduce losses. One concern with underwater noodling is that it is more difficult to control. The inlet temperature has to be low enough for the noodles to form upon contact with cold water, but must not be too cold or the material will set within the head. Materials with low gelatin concentrations are difficult to noodle as there is a narrow temperature range between being able to noodle and setting. Chillplate noodling will work as long as the material will set. However, waste through fines will be greater.

The nuclei in the dispersion are amplified (electrolessly plated) by treatment with a solution of a hydroquinone monosulfonate or similar reducing compound, such as hydroxyamine ascorbic acid, together with a plating solution containing a silver salt and a sulfite complexing agent. The plating solution is preferably prepared by mixing a silver salt solution with a sulfite/-bisulfite solution, then adding the combined solutions rapidly to the dispersion. The sulfite complexing solution may contain an agent for promoting the growth of silver platelets, e.g., a calcium salt such as calcium acetate.

Amplification converts the silver to a metastable, non-spherical form. The progress of the reaction is confirmed by the color change undergone by the particles, which progressively proceed from the initial yellow to orange, magenta, purple, and finally blue. Extended amplification may be used to produce a green color. Thus, any of the intermediate colors, as well as the blue form, can be prepared. To stop the reaction at a desired color, the reaction may be quenched by dilution with water or by draining off the reactants.

The silver-containing noodles are collected by filtration through a nylon mesh bag or similar means and washed. The noodles can then be allowed to stabilize in water, and are then melted and purified by filtration. The resulting melt is poured into a suitable container and chilled for storage, or may be coated immediately on a support.

The metastable form of silver prepared by the foregoing procedure has extended shelf life under refrigeration. The collected particles, if not yellow, are non-spherical, commonly containing a large number of tabular grains with an average edge length of approximately 20 nm up to about 40 nm, and a thickness of about 5 to 20 nm, preferably 5–12 nm. As to such tabular grains or platelets, the average edge length is often at least twice the thickness of the grains.

The colloidal metastable silver is next coated onto a support for a photosensitive element according to the invention. One such element comprises three successive silver halide (e.g., cubic silver chloride) emulsion layers coated onto a suitable support, such as a cellulose triacetate or polyester terphthalate film. The top layer is made sensitive to blue light by treating the silver halide grains with a spectral sensitizing dye. The middle layer is similarly sensitive to green light, and the bottom layer to red light. Upon exposure and development, the couplers present in each layer give yellow, magenta, and cyan colors for the top, middle and bottom layers, respectively. The blue antihalation layer absorbs red light most effectively, reducing halation in the adjoining red-sensitive layer.

If the layers are rearranged so that the blue-sensitive layer is on the bottom, then the antihalation layer should be made to have a yellow color. Similarly, if the green layer is on the bottom, then a green-absorbing antihalation layer may be used. In each case, the antihalation layer color is selected to absorb light which the adjoining photosensitive layer is sensitive to.

In the foregoing process, certain parameters can be used to optimize results. The initial preparation of the nuclei is important to improve quality of the final dispersion. Nuclei of small and uniform dimension provide better control over the color of the final dispersion and opacity of the colloidal silver. Thus, a maximum average particle size of about 5–7 nanometers is preferred to provide ultra-fine particles. When gelatin is used in the preparation of the nuclei, its concentration can be relatively low, but should still allow the dispersion to be chill-set firmly. Weight ratios of nuclei material, e.g., silver to dry gelatin, are not critical. Silver:gelatin ratios from about 1:30 to 1:5 are generally useful.

Concentration and size are of equal importance in determining color and stability of the amplified particles. In the amplification mixture, the weight ratio of the amplified metallic silver to peptizing agent may be as high as about 1:1. The amplification value of nuclei to silver controls the degree of color change. An amplification factor of 2 gives a discernable color change; values as high as 50 may be used. Amplification factor refers to the ratio of the average weight of silver per particle in the silver dispersion product to the average weight of silver in the starting nuclei.

A negatively charged complexing agent, such as a sulfite as described above, enhances formation of platelets By contrast, other known agents, such as thiocyanates and thiosulfates, tend to recrystallize or otherwise convert the formed platelets into spheres, the stable phase, in contrast to sulfite which preferentially stabilizes platelet (non-spherical) growth. A weight ratio of sodium sulfite to silver nitrate of from 2:1 to 20:1 has proven useful. Calcium and other alkaline earth ions also promote of platelet formation and uniformity of amplification. Calcium is provided by gelatin itself, but can be added as any convenient salt at a low concentration.

The pH for amplification may be maintained between 3.0–10.0. At lower pHs, the amplification rate decreases. A preferred pH range is 7–9.5. Borax conveniently buffers the amplification solution at a pH of 9.0–9.5. Other buffers may be used to obtain a desired pH, e.g., sulfite and bisulfite can be used as buffers to maintain a pH of from 7 to 9.

In the preparation of the solutions for the amplification reaction and of the colloidal silver, recrystallizing agents that convert the silver back to its yellow form should be excluded. In particular, halides and other possible recrystallizing agents, such as certain surfactants, should also be avoided.

Materials that can be easily plated with silver can be substituted for silver as nuclei. Examples include noble metals such as gold and palladium, a heavy metal sulfide such as silver sulfide, and nickel sulfide. Generally, however, noble metals have the highest stability in gelatin dispersions, and are thus preferred.

Colloidal silver prepared according to the invention has higher density per unit mass than other forms of silver used for halation protection coated typically at 25–40 mg per square foot. Thus, an antihalation layer according to the invention having coverage of up to 20 $mg/ft^2$, particularly 5 to 10 $mg/ft^2$, most preferably 6 to 8 $mg/ft^2$, can provide antihalation effects as good or better than comparable prior silver antihalation materials employed at higher coverage levels. However, the colloidal silver of the invention is metastable and is converted by the action of halides to a yellow form. Since halides are normally found in photographic emulsions coated next to the antihalation layer, conversion can occur unless the metastable silver is chemically passivated against halide-induced conversion to yellow.

According to a further aspect of the invention, various classes of agents that form insoluble salts with silver (e.g., thiols, substituted benzotriazoles, substituted tetraazoindines, etc.,) having Ksp's of $10^{-11}$ or smaller can be added to passivate silver against halide conversion to the yellow form. For example, if a blue silver of the invention in slurry form is equilibrated with a 1-phenyl-1H-tetrazole-5-thiol sodium salt solution, the resulting product is insensitive to halides. However, such passivating agents can migrate from silver onto a silver halide emulsion grain in a coating under extremely moist storage conditions. This can change the sensitometric response of the photographic emulsion. For this reason, other passivating agents, preferably ones which have minimal migrating tendencies or which have little or no sensitometric effect on photographic emulsions, are more useful.

A class of mercaptotetrazoles which have a hydrophilic-substituted moiety in place of the phenyl group have these characteristics. For example, if the phenyl group of the mercaptotetraazole is replaced by —$CH_2$—COOH, the resulting thiol is known to have much less effect on silver halide photographic emulsions than its phenyl counterpart. Further, the carboxymercaptotetrazole (CMT), when adsorbed to silver, interacts with gelatin to form an irreversible bond. CMT has the formula:

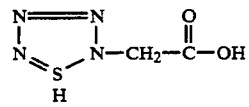

This bonding substantially lowers the facility of the thiol to wander under moist storage conditions. In fact, the ability of CMT to form a bond with gelatin when adsorbed to silver is so dramatic that a stable melt of CMT-treated silver in gelatin is not possible because an insoluble mass begins to form within 5 minutes after adding CMT to a silver melt. For this reason, CMT can only be used as a o silver passivating agent if it is dual melted with the silver and added at the time of coating on the support. Lower alkyl esters of CMT, such as a compound wherein the —OH group of CMT is changed to —O—$C_3H_7$, passivates silver but does not interact with the gelatin in the same manner as CMT.

Tanning developers such as tannic acid and unsulfonated hydroquinone can crosslink with gelatin. Antihalation gels prepared with these reducing agents have potentially serious problems upon remelting when stored for just a few weeks under refrigeration. Thus, many reducing agents normally used in preparing silver have adverse effects if used in the present invention. However, when hydroquinone monosulfonate or ascorbic acid is used as the reducing agent, melts of blue silver can be stored indefinitely without becoming insoluble.

The invention is further illustrated in the following examples.

EXAMPLE 1

To 112 grams of gelatin is added 3,488 grams of distilled water, and the resulting mixture is heated to approximately 47° C. to dissolve the gelatin. To this is added 4.0 grams of calcium acetate and 2.0 grams of potassium borohydride. Immediately thereafter 6.0 grams of silver nitrate dissolved in 1.0 liter of distilled water is added with very rapid stirring. The final weight is adjusted to 5.0 kg by addition of distilled water. The product is then cooled to close to the gelatin temperature and passed through a small orifice into chilled water, whereupon very fine noodles are formed. These noodles serve as the amplification catalyst for forming blue silver in-situ (i.e., directly in the solid phase). As a matter of convenience and to prevent the noodles from forming a fused mass, the noodles are diluted with water, 1 part water to 3 parts noodles.

To 650 grams of borohydride-reduced silver nuclei (75% noodles and 25% water) is added 6.5 grams of potassium hydroquinone monosulfate plus 0.29 grams KCl dissolved in 81 grams distilled water. The noodle slurry is cooled to about 6° C. In separate containers the following two solutions A and B are prepared:

A. 19.5 grams sodium sulfite (anhydrous) 0.98 grams sodium bisulfite (anhydrous) 122.0 grams distilled water.

B. 9.75 grams silver nitrate 122.0 grams distilled water. Solutions A and B were mixed to form a white precipitate which disappeared upon continued stirring. This mixture was then immediately added to the noodle slurry in a short time (within 5 minutes) with rapid stirring. The temperature was held at 100° C. and amplification was allowed to proceed for about 80 minutes until all of the soluble silver salt was reduced onto the nuclei. The resulting blue slurry particles were washed in a nylon mesh bag by passing tap water through the slurry and allowing the wash water to pass through the bag for approximately 30 minutes so that all of the salts were washed out. The washed blue silver dispersed in the gel slurry was drained until the product weighed 412 grams to obtain a blue silver dispersion which, when melted, had a silver concentration of 1.5% by weight.

EXAMPLE 2

The blue silver (in the slurry form) of Example 1 is equilibrated with 0.45 grams of 1-phenyl-1H-tetrazole-5-thiol sodium salt dissolved in 500 grams of cold tap water for 15 minutes, then drained. The resulting product is insensitive to halides, such as AgCl or AgBr.

EXAMPLE 3

A coating configuration employing blue silver as described for halation protection is prepared by coating the emulsion of Example 1 on a support made of cellulose triacetate with coverage of blue silver of 8 mg/sq. ft. and gelatin of 80 mg/sq. ft. Conventional multilayered photosensitive emulsion layers are then formed over the antihalation layer in red-green-blue order with the red layer adjacent to the antihalation layer according to the procedure described in Taber U.S. Pat. No. 4,980,267, issued Dec. 25, 1990, at cols. 13–15, the entire contents of which are incorporated herein by reference.

COMPARATIVE EXAMPLE

Blue silver was prepared according to the procedure of U.S. Pat. No. 2,921,914. Three solutions A, B and C were prepared as follows:

A. To 630 grams of distilled water was added 100 grams of dry gelatin. After the gelatin was completely dissolved by heating to 40° C., the pH was adjusted to 8.80 with 5% NaOH.

B. To 125 grams of distilled water was added 32.0 grams of silver nitrate and 5.0 grams of strontium nitrate.

C. To 270 grams of distilled water was added 22.5 grams of anhydrous sodium sulfite and 3.7 grams of tannic acid.

Solution B was dumped into solution A with rapid stirring at 40° C. After waiting 5 minutes, solution C was added. Digestion proceeded for 20 minutes, and then the mixture was chill set. The resulting blue gel was noodled and washed until the wash water was completely clear of yellow coloration. The noodles were drained until the net weight was 1,440 grams, then melted and filtered.

The resulting product was 1.4% silver by weight. It showed signs of insolubilization within a period of three weeks after being stored at 3° C.

EXAMPLE 4

The emulsion of Example 1 (blue silver), the Comparative Example (U.S. Pat. No. 2,921,914) and a conventional grey antihalation gel were coated on a support of 7 mil thick polyester terphthalate each at a density of 25 mg/sq. ft. The covering power was measured with an X-Rite Photographic Densitometer in transmission mode with a status A filter, with the following results:

| | Optical Density: | | |
|---|---|---|---|
| Color | Blue Silver | U.S. 2,921,914 | Gray Silver |
| Blue | 1.62 | 0.46 | 0.39 |
| Green | 2.01 | 0.81 | 0.33 |
| Red | 2.44 | 1.14 | 0.33 |

Covering power is a measure of the efficiency of a light absorbing material to attenuate light. For a given laydown of silver in the table above shows that blue silver is much more efficient than either of the other antihalation materials.

The higher covering power of blue silver according to the invention is related to its morphology. Transmission electron micrographs show that the blue silver of Example 1 consisted of well-defined tabular grains of approximately 20–30 nm edge lengths and are about, 7 nm thick. The blue grains of Comparative Example the consisted of irregularly shaped plates approximately 100–200 nm wide and over 20 nm thick. The conventional gray gel consisted of filaments that are 20–30 nm wide and over 100 nm long and 15–20 nm thick. The grains of the invention having the smallest dimensions had the highest absorption efficiency.

While several embodiments of the invention have been described, it will be understood that it is capable of further modifications, and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

I claim:

1. A photographic element, comprising:

a reflective support;

at least one layer of a photosensitive silver halide emulsion superposed on the support; and an antihalation layer interposed between the support and the photosensitive layer, which antihalation layer consists essentially of tabular silver grains distributed in a colloidal medium, wherein the tabular grains have an average edge length at least twice the thickness thereof and a color selected from orange, red-orange, red, purple and blue, the tabular grains being metastable in the presence of halides such that the tabular grains can be converted in the presence of a halide to a yellow form, wherein the antihalation layer further contains an amount of a passivating agent effective to retard the conversion of the grains to the yellow form, and wherein the antihalation layer is sufficiently thick to provide antihalation effects, and the tabular grains have a maximum thickness of about 20 nm.

2. The photographic element of claim 1, wherein the colloidal medium comprises gelatin.

3. The photographic element of claim 1, wherein the photographic element is a color photographic element having three photosensitive layers sensitive to blue, green and red light, respectively, the red sensitive layer being disposed beneath the green and blue-sensitive layers adjacent the antihalation layer, and the antihalation layer has a blue color.

4. The photographic element of claim 1, wherein the passivating agent is selected from thiols, benzotriazoles, and tetraazoindines.

5. The photographic element of claim 1, wherein the passivating agent is a mercaptotetrazole compound which does not tend to migrate from the antihalation layer onto a silver halide emulsion grain in the photosensitive emulsion layer under moist storage conditions.

6. The photographic element of claim 1, wherein the tabular grains have an orange color of a shade determined by the extent of amplification of the grains from yellow silver nuclei.

7. The photographic element of claim 1, wherein the tabular grains have a red-orange color of a shade determined by the extent of amplification of the grains from yellow silver nuclei.

8. The photographic element of claim 1, wherein the tabular grains have a red color of a shade determined by the extent of amplification of the grains from yellow silver nuclei.

9. The photographic element of claim 1, wherein the tabular grains have a purple color of a shade determined by the extent of amplification of the grains from yellow silver nuclei.

10. The photographic element of claim 1, wherein the tabular grains have a blue color of a shade determined by the extent of amplification of the grains from yellow silver nuclei.

11. The photographic element of claim 1, wherein the tabular grains have a maximum average edge length of about 40 nm and a thickness in the range of from 5 to 20 nm.

12. The photographic element of claim 1, wherein the antihalation layer has a maximum coverage of about 20 mg silver per square foot of the antihalation layer.

13. A photographic element, comprising:

a reflective support;

at least one layer of a photosensitive silver halide emulsion superposed on the support;. and an antihalation layer interposed between the support and the photosensitive layer, which antihalation layer consists essentially of tabular silver grains distributed in a colloidal medium, wherein the tabular grains have an average edge length at least twice the thickness thereof, a maximum average edge length of about 40 nm, a thickness in the range of from 5 to 20 nm, and a color selected from orange, red-orange, red, purple and blue, the tabular grains being metastable in the presence of halides such that the tabular grains can be converted in the presence of a halide to a yellow form, and wherein the antihalation layer further contains an amount of a passivating agent effective to retard the conversion of the grains to the yellow form.

14. The photographic element of claim 13, wherein the antihalation layer contains from 5 to 10 mg silver per square foot, the average edge length of the tabular grains is in the range of 20 to 40 nm, and the thickness of the tabular grains is in the range of 5 to 12 nm.

15. The photographic element of claim 13, wherein the photographic element is a color photographic element having three photosensitive layers sensitive to blue, green and red light, respectively, the red sensitive layer being disposed beneath the green and blue-sensitive layers adjacent the antihalation layer, and the antihalation layer has a blue color.

16. A photographic element, comprising:

a reflective support;

at least one layer of a photosensitive silver halide emulsion superposed on the support; and an antihalation layer interposed between the support and the photosensitive layer, which antihalation layer consists essentially of tabular silver grains distributed in a colloidal medium, wherein the tabular grains have a color selected from orange, red-orange, red, purple and blue and are metastable in the presence of halides such that the tabular grains can be converted in the presence of a halide to a yellow form, and wherein the antihalation layer further contains an amount of a passivating agent effective to retard the conversion of the grains to the yellow form.

17. The photographic element of claim 16, wherein the passivating agent is selected from thiols, benzotriazoles, and tetraazoindines.

18. The photographic element of claim 16, wherein the passivating agent is a mercaptotetrazole compound which does not tend to migrate from the antihalation layer onto a silver halide emulsion grain in the photosensitive emulsion layer under moist storage conditions.

19. The photographic element of claim 18, wherein the mercaptotetrazole compound is carboxymercaptotetrazole, and the colloidal medium is gelatin.

* * * * *